United States Patent [19]

Bolte et al.

[11] Patent Number: 5,002,223

[45] Date of Patent: Mar. 26, 1991

[54] EASY-OPEN PACKAGE WITH OUTWARDLY PROJECTING OPEN TAB

[75] Inventors: Georg Bolte, Vechelde; Dieter Heinecke, Wendeburg; Günter Hexel, Braunschweig, all of Fed. Rep. of Germany

[73] Assignee: Firma Schmalbach-Lubeca AG, Braunschweig, Fed. Rep. of Germany

[21] Appl. No.: 463,369

[22] Filed: Jan. 11, 1990

[30] Foreign Application Priority Data

Jan. 19, 1989 [DE] Fed. Rep. of Germany ..... 3901503

[51] Int. Cl.[5] ..... B65D 41/32

[52] U.S. Cl. ..... 229/123.2; 206/628; 220/276; 229/3.5 MF; 229/125.35

[58] Field of Search ..... 229/123.2, 125.35, 3.5 MF; 206/633, 628; 220/276

[56] References Cited

U.S. PATENT DOCUMENTS

| | | | |
|---|---|---|---|
| 3,159,303 | 12/1964 | Betner | 206/628 |
| 3,572,579 | 3/1971 | Mueller et al. | 206/628 |
| 4,351,473 | 9/1982 | Manizza | 229/125.35 |
| 4,689,099 | 8/1987 | Ito et al. | 229/125.35 |
| 4,693,390 | 9/1987 | Hekal | 229/123.2 |
| 4,865,217 | 9/1989 | Yoshimoto | 229/125.35 |
| 4,913,307 | 4/1990 | Takata et al. | 220/276 |

*Primary Examiner*—Stephen P. Garbe

*Attorney, Agent, or Firm*—Herbert Dubno; Andrew Wilford

[57] ABSTRACT

An easy-open package comprises a vessel part forming an upwardly open compartment and having an annular rim surrounding the compartment and a foil part adhered to the rim of the vessel part all around the compartment, unitarily formed with an open tab which projects laterally past the rim, and formed with a tear line extending around the compartment except at the tab and extending to an outer periphery of the foil part to each side of the tab. One of the parts is formed as a laminate including a metal layer, a synthetic-resin layer, and a relatively weak bond securing the synthetic-resin layer to the metal layer. The synthetic-resin layer of the one part is bonded to the other part along an annular strip running around the rim with a relatively strong bond and the one part is formed in the synthetic-resin layer with at least one secondary tear line at the tab.

6 Claims, 3 Drawing Sheets

EASY-OPEN PACKAGE WITH OUTWARDLY PROJECTING OPEN TAB

FIELD OF THE INVENTION

The present invention relates to an easy-open package of the type a foodstuff is packed in. More particularly this invention concerns such a package having a cover foil formed with an outwardly projecting tab that is lifted to strip off this foil.

BACKGROUND OF THE INVENTION

A standard easy-open package comprises a vessel having a flat rim and a profiled or planar cover foil that is bonded to the vessel at the rim. The vessel and foil together form one or more compartments that can contain respective foodstuffs, although it is of course within the scope of this invention for other types of materials to be thus packaged. As described in German utility model 6,901,362 the cover foil is unitarily formed with an open or tearoff tab that projects laterally out past the rim of the vessel. Furthermore the metal of the cover foil is formed with a tear line that extends around the compartment, just within the inner edge of its periphery, and that runs out on each side of the tearoff tab. Thus the user can lift the tearoff tab, separating the metal layer here from the rest of the foil by breaking the bond between the vessel and the tearoff tab and then tearing the plastic layer at the lines flanking it so as to pull it free from the rim and tear out the center of the foil to expose the contents of the compartment, normally leaving the plastic layer of the tab at least still sticking to the rim.

Both the vessel and the foil can be made of a metal, of a synthetic-resin, or of a laminate of both. A particularly advantageous system has a rigid vessel to which is bonded a polypropylene-coated metallic foil, the bonding being done ultrasonically along bond lines running around the perimeters of the compartments, although a cold or adhesive bond is also within the scope of this invention. Similarly in German patent document No. 3,613,155 the vessel is formed of such a metal/plastic laminate that itself is formed with the tear line so that when the foil is stripped it takes part of the rim of the vessel with it.

Such systems provide a durable and hermetic seal, but normally require considerable force to open.

OBJECTS OF THE INVENTION

It is therefore an object of the present invention to provide an improved easy-open package.

Another object is the provision of such an improved easy-open package which overcomes the above-given disadvantages, that is which is easy to open while still providing a very rugged and hermetic seal between the cover foil and the vessel.

SUMMARY OF THE INVENTION

The instant invention is an improvement on an easy-open package comprising a vessel part forming an upwardly open compartment and having an annular rim surrounding the compartment and a foil part adhered to the rim of the vessel part all around the compartment, unitarily formed with an open tab which projects laterally past the rim, and formed with a tear line extending around the compartment except at the tab and extending to an outer periphery of the foil part to each side of the tab. According to this invention one of the parts is formed as a laminate including a metal layer, a synthetic-resin layer, and a relatively weak bond securing the synthetic-resin layer to the metal layer. The synthetic-resin layer of the one part is bonded to the other part along an annular strip running around the rim with a relatively strong bond and the one part is formed in the synthetic-resin layer with at least one secondary tear line at the tab.

Thus there is only separation of the foil from the vessel in a very limited location, further separation being easy tearing along the primary tear line. Only a small patch of the actual bond between the foil and vessel need be separated. Such separation also takes place at the weak bond in the cover foil, making it fairly easy.

According to a further feature of this invention the one part has two such secondary tear lines flanking the tab. Thus these tear lines do not traverse the seal strip. The one part can either be the vessel part in which case the secondary tear line is formed in the rim thereof or it can be the foil part.

The first-mentioned tear line is cut in the metal layer and the secondary tear line can be annular, flank the tab, and cross the strip.

DESCRIPTION OF THE DRAWING

The above and other objects, features, and advantages will become more readily apparent from the following, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

DESCRIPTION

Figure 1:
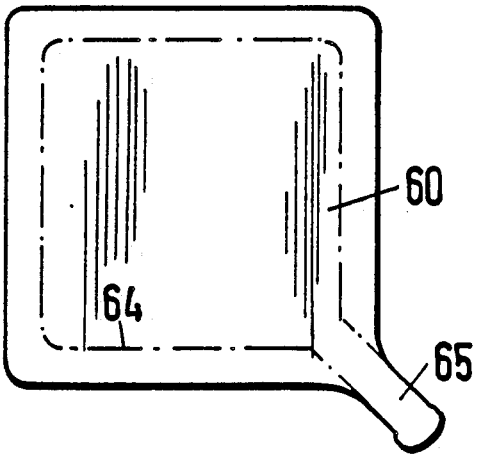
FIG. 1 is a top view of a cover foil according to this invention.
Figure 3:
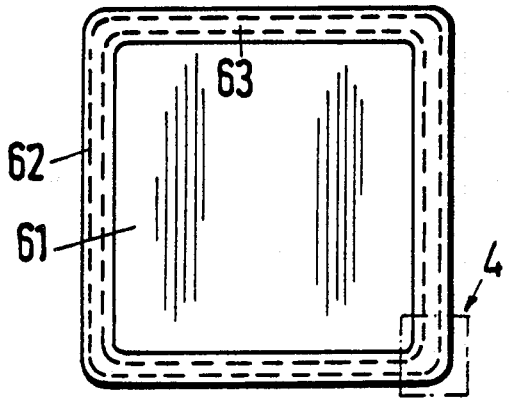
FIG. 3 is a top view of a vessel for use with the cover foil of FIG. 1.

As seen in FIGS. 1 through 5 a package according to this invention is formed by a cover foil 60 and a base part or vessel 61. The vessel 61 is formed with a rim 62 to which the outer periphery of the cover foil 60 is adhered along an annular strip 63. The foil 60 is formed with a corner tab 65 that projects out past one corner of the rim 62 and with a tear line 64 that runs around the inside of the rim 62 except at the corner of the tab 65 where it runs out to the outer edge of the foil 60 along each side of the tab 65.

Figure 2:
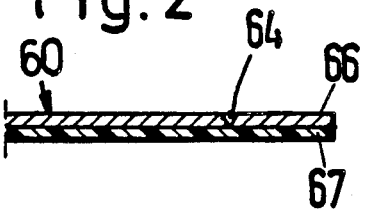
FIG. 2 is a section through the foil of FIG. 1.

FIG. 2 shows how the foil 60 is formed by an upper layer 66 of metal, here aluminum, in which the tear line 64 is formed, and a lower layer 67 of a thermoplastic synthetic resin. The upper face of the layer 66 can be lacquered to receive printing for product identification or the like.

Figure 4:
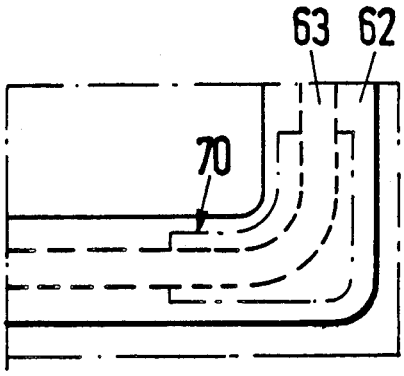
FIG. 4 is a large-scale view of the detail indicated at 4 in FIG. 3.
Figure 5:
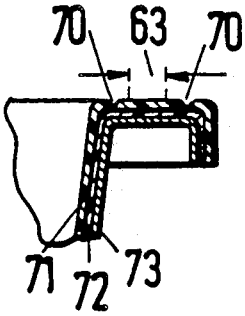
FIG. 5 is a section through the detail of FIG. 4.
Figure 6:
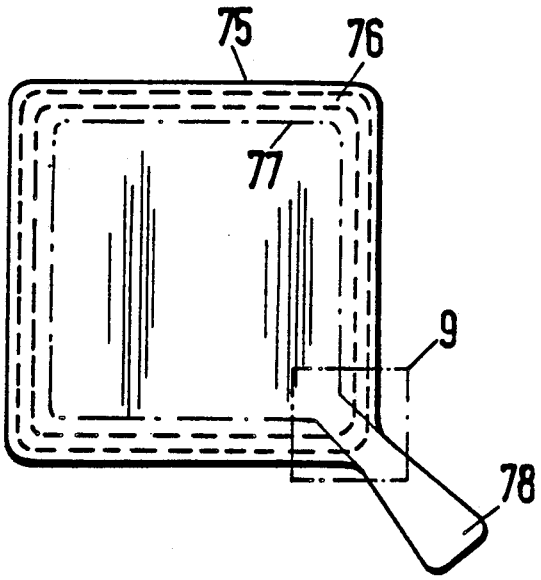
FIGS. 6 and 7 are top views of another cover foil and vessel according to this invention.
Figure 7:
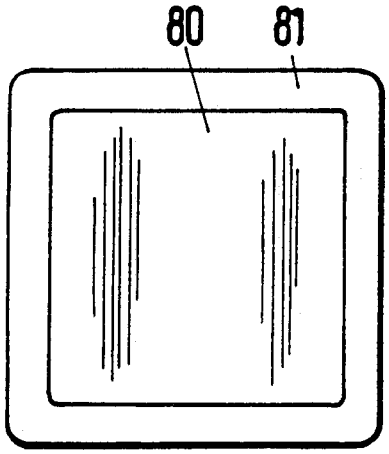
Figure 9:
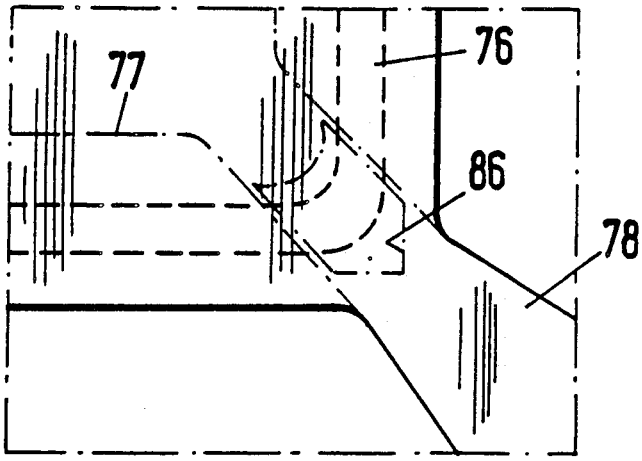
FIG. 9 is a large-scale view of the detail indicated at 9 in FIG. 6.

FIGS. 4 and 5 show how the vessel 61 is formed by an upper layer 71 of a synthetic resin, an intermediate layer 72 also of a synthetic resin, and a lower layer 73 of a metal, once again aluminum. The layer 71 is normally of the same thermoplastic as the layer 67 of the foil 60 to facilitate bonding along the strip 63 and the layer 72 serves primarily to bond this layer 71 to the layer 73. The resins are chosen such that bond between the layers 71 and 67 will be substantially stronger than the bond between the layer 71 and the layer 72 and/or 73. The lower or outer face of the aluminum layer 73 can also be lacquered like the upper layer of the layer 66. According to this invention the layer 71 is formed along the inside and outside of the strip 63 in the region where the tab 65 crosses the rim 62 with tear lines 70.

Thus to open the package the user grips and lifts the tab 65. Since the bond between the layers 67 and 71 is stronger than that formed by the layer 72 between the layers 71 and 73, the layer 71 between the lines 70 will tear free of the base 61. Once this corner is freed, further lifting of the tab 65 will tear out the portion of the foil 60 lying within the tear line 64. The user will end up with the center part of the foil 60 and a piece of the layer 71 in his hand.

In the system of FIGS. 6 through 10 a base or compartment-defining vessel 80 has a rim 81 to which a cover foil 75 is secured along a glue or bond strip 76 This foil 75 has a corner open tab 78 and is formed like the foil 60 of FIG. 1 with a tear line 77 running along the perimeter of the compartment formed by the base 80 and to each side of the tab 78.

Figure 8:
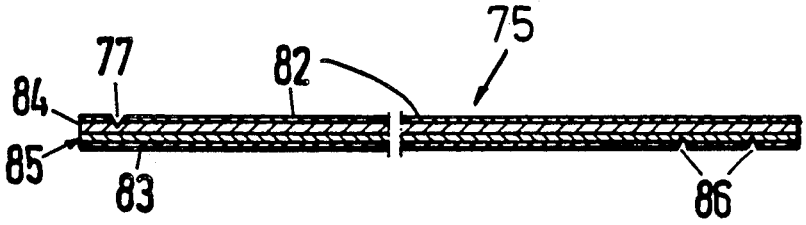
FIG. 8 is a cross section through the foil of FIG. 6.
Figure 10:
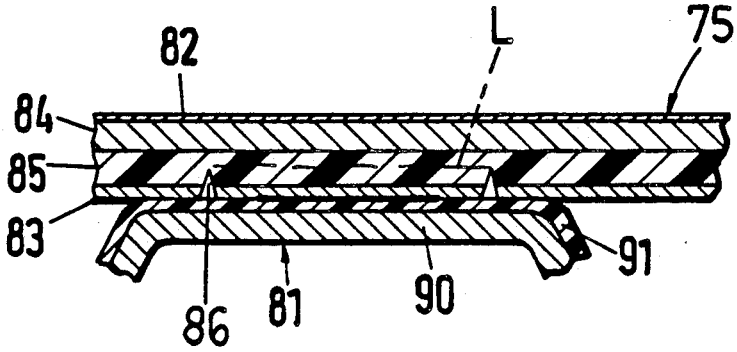
FIG. 10 is a large-scale section through the detail of FIG. 9.

As seen in FIGS. 8 and 10 the foil 75 is shown to comprise four layers: an aluminum core 84, a protective paint layer 82 on the upper face of the core 84, a hot-bonding layer 83, and a stripping layer 85 that secures the bond layer 83 to the metal layer 84 with a relatively weak bond. The tear line 77 is cut through the paint layer 82 and part way through the aluminum layer 85. In addition an annular tear line is cut through the bond layer and at least part of the way through the stripping layer 85 in the region of the tab 78. This line 86 extends along the inside and outside of the attachment strip 76 and also across it generally underneath the upper tear line 77.

FIG. 10 shows how the vessel 80 is formed of a base layer 90 of aluminum carrying a coating 91 of a synthetic resin that will bond with a very strong bond to the layer 83, normally being of the same thermoplastic resin as this layer 83.

Thus when the tab 78 of the system of FIGS. 6 through 10 is lifted the foil 75 will tear along the lines 86 and 77, separating from the foil 75 a patch of itself that will rip loose generally long line L of FIG. 10, that is somewhere between the foil 84 and the bond layer 83. Due to the weak bond created by the layer 85 such separation will be relatively easy to effect, making opening the container similarly easy Once the corner is separated as described, further tearing takes place along line 77 to open up the package.

The system of this invention is equally applicable to multicompartment packages, in which case the foil is formed with a separate tab and tear line for each compartment. Such obvious variations are intended to be covered by the appended claims.

I claim:

1. In an easy-open package comprising:

a vessel part forming an upwardly open compartment and having an annular rim surrounding the compartment; and a foil part adhered to the rim of the vessel part all around the compartment, unitarily formed with an open tab which projects laterally past the rim, and formed with a tear line extending around the compartment except at the tab and extending to an outer periphery of the foil part to each side of the tab; the improvement wherein one of the parts is formed as a laminate including a metal layer, a synthetic-resin layer, and means bonding the synthetic-resin layer to the metal layer with a relatively weak bond;

the synthetic-resin layer of the one part is bonded to the other part along an annular strip running around the rim with a relatively strong bond, and the one part is formed in the synthetic-resin layer with at least one secondary tear line at the tab.

2. The package defined in claim 1 wherein the one part has two such secondary tear lines flanking the tab.

3. The package defined in claim 1 wherein the one part is the vessel part and the secondary tear line is formed in the rim thereof.

4. The package defined in claim 1 wherein the one part is the foil part.

5. The package defined in claim 4 wherein the first-mentioned tear line is cut in the metal layer.

6. The package defined in claim 1 wherein the secondary tear line is annular, flanks the tab, and crosses the strip.

* * * * *